United States Patent [19]

Pollock et al.

[11] Patent Number: 4,482,392

[45] Date of Patent: Nov. 13, 1984

[54] CONDUIT CLEANING PROCESS

[75] Inventors: Charles B. Pollock; Patrick J. Murzyn; Stephen O. Brennom, all of Houston; James N. Lambert, Missouri City, all of Tex.

[73] Assignee: Union Carbide Corporation, Danbury, Conn.

[21] Appl. No.: 377,788

[22] Filed: May 13, 1982

[51] Int. Cl.[3] ..... B08B 9/02

[52] U.S. Cl. ..... 134/7; 134/8; 134/39; 165/95

[58] Field of Search ..... 134/7, 8, 39; 51/319, 51/320, 321, 411, DIG. 30; 15/3.5; 165/95; 201/2; 137/15

[56] References Cited

U.S. PATENT DOCUMENTS

| | | | |
|---|---|---|---|
| 3,485,671 | 12/1969 | Stephens | 134/7 |
| 4,038,786 | 8/1977 | Fong | 51/320 |
| 4,289,541 | 9/1981 | Wallner et al. | 134/7 |
| 4,297,147 | 10/1981 | Nunciato et al. | 134/7 |
| 4,380,477 | 4/1983 | Saunders | 134/8 X |
| 4,411,705 | 10/1983 | Easley et al. | 134/8 |

FOREIGN PATENT DOCUMENTS

| | | | |
|---|---|---|---|
| 626704 | 9/1961 | Canada | 51/320 |
| 786725 | 9/1935 | France | 51/320 |
| 1397102 | 6/1975 | United Kingdom | 51/320 |

*Primary Examiner*—Marc L. Caroff

*Attorney, Agent, or Firm*—Alvin H. Fritschler

[57] ABSTRACT

The in-situ cleaning of conduits is enhanced by the passage therethrough of a propelling gas stream having entrained therein cleaning particles of a regular, non-random configuration, and having less than spherical symmetry.

39 Claims, No Drawings

CONDUIT CLEANING PROCESS

BACKGROUND OF THE INVENTION

1. Field of the Invention

This invention relates to the cleaning of the interior surfaces of conduits. More particularly, it relates to the improved cleaning of conduits having difficult to remove deposits on said interior surfaces thereof.

2. Description of the Prior Art

The Sandjet process has been developed to facilitate the in-situ cleaning and drying of pipelines and the decoking and cleaning of furnace tubes. In accordance with this process, cleaning particles are entrained in a propelling fluid stream and introduced into the conduit to be cleaned at a velocity sufficient to effect the desired cleaning action. For pipeline applications, the cleaning particles generally comprise an abrasive material, such as flint, whereas in other applications, impact resistant, non-angular, non-abrasive particles, such as steel shot, are employed as cleaning agents.

The use of steel shot in the decoking of fired heater tubes is described in the Nunciato et al. patent, U.S. Pat. No. 4,297,147. As noted therein, the Sandjet process using steel shot particles provides significant advantages as compared with the known alternative decoking approaches, such as turbining, hydroblasting and steam-air decoking. In addition to the advantages noted in the patent, there is a growing appreciation in the art of the energy savings that can be derived as a result of furnace tubes having been decoked by means of the Sandjet process as compared with the results obtainable by the most frequently used alternative approach, i.e. steam-air decoking.

While steel shot is found to have a highly effective impact cleaning action on coke deposits, certain high heat duty or thermally abused furnace applications result in the formation of difficult-to-remove coke deposits that are not removed to the extent desired by the Sandjet process using steel shot as the cleaning agent. Such deposits have likewise been found generally resistant to angular, abrasive cleaning agents, such as flint. In addition, cleaning agents such as flint are found to cause severe erosion of the bends of furnace tubes, even in cases where a difficult-to-remove deposit may not have been satisfactorily removed by such agents from the straight sections of said tubes. While non-angular particles, such as steel shot, are non-abrasive in character, it has been found that such particles will also tend to cause minimal erosion of the bends of furnace tubes treated by the Sandjet process, likewise even in cases where a difficult-to-remove deposit may not have been satisfactorily removed from the straight sections of the tubes. The problem of erosion of bends is particularly important in furnace tube sections having welded return bends, in which such erosion may lead to premature tube failure and the need for additional furnace downtime for replacement of the eroded bends. When plugged headers are employed in place of welded bends, on the other hand, bend erosion problems are of lesser consequence.

While the effectiveness of cleaning is obviously an important measure of the performance of the Sandjet process, or of any other cleaning technique, the trade-off or balance between the desirable cleaning action achieved, and the undesired erosion resulting from the cleaning operation, is often of equal or greater importance in determining the success of the operation. Thus, in some instances, an improvement in the cleaning action of the cleaning agents is desired, while the highly desirable advantages associated with the Sandjet process are retained, with the associated erosion being tolerable in particular applications. In other instances, however, improvements in the Sandjet process are desired, particularly with respect to difficult-to-remove deposits, such that an advantageous balance of desired cleaning action and undesired erosion is achieved. It will be appreciated that such an improvement in cleaning action and/or in the balance of cleaning action and erosion effect is of interest not only in the indicated furnace tube decoking applications, but with respect to other suitable applications of the Sandjet process, such as in pipeline cleaning and drying, heat exchanger tube descaling and other cleaning applications.

It is an object of the invention, therefore, to provide an improved Sandjet process for the in-situ cleaning of the interior surfaces of conduits.

It is another object of the invention to provide a process for the in-situ cleaning of conduits containing difficult-to-remove deposits.

It is another object of the invention to provide a process for the propelling of particles through a conduit to be cleaned with an enhanced cleaning action with respect to the deposits on the interior surfaces thereof.

It is a further object of the invention to provide a process for the propelling of cleaning particles through a conduit to be cleaned at an advantageous balance of desired cleaning action and undesired erosion or abrasion for a given application.

With these and other objects in mind, the invention is hereinafter described in detail, the novel features thereof being particularly pointed out in the appended claims.

SUMMARY OF THE INVENTION

The invention resides in the carrying out of the Sandjet process by the propelling of regular, non-random cleaning particles having less than spherical symmetry through the conduit to be cleaned. As a result of the aerodynamic orientation of such particles in the propelling gas stream, an advantageous balance of desired cleaning action and undesired erosion of the interior surfaces of the conduit.

DETAILED DESCRIPTION OF THE INVENTION

The objects of the invention are accomplished by the use of cleaning agents found to enhance the cleaning action of the Sandjet process vis-a-vis the use of steel shot, flint or other materials heretofore employed in the in-situ Sandjet process for the cleaning of conduits. As indicated above, such cleaning agents comprise particles having a regular, non-random configuration with less than spherical symmetry. When such particles are propelled through a conduit to be cleaned, it has been found that the number of impacts of the cleaning particles and the angle of impact of said particles with the interior surfaces of the conduits are increased as a result of the aerodynamic orientation of the particles in the propelling gas stream. As a result, the cleaning action of the Sandjet process is surprisingly and unexpectedly enhanced, with an advantageous balance of desired cleaning action and undesired erosion or abrasive action being achieved in a manner enhancing the overall conduit cleaning operation. It will be apparent from the following further description that the process of the invention can be employed in a manner advantageous to the particular requirements of any given conduit cleaning application.

In the Sandjet process as employed for pipeline cleaning applications, flint, grit or like materials of irregular, random configuration have been employed because of their abrasive characteristics. Such materials have been considered as the most logical and effective cleaning agents to employ in such applications of the Sandjet process. It will be appreciated, however, that a considerable amount of erosion may occur in the conduit being cleaned because of the abrasiveness of materials such as flint. This is particularly the case with respect to bends, although flint is sometimes employed to facilitate furnace tube decoking when the consequent amount of erosion can be tolerated. Nevertheless, the use of non-angular, non-abrasive cleaning particles, such as steel shot, has been generally preferred for furnace tube decoking applications because of the very much less damage caused to the bends of such tubes as compared with the use of flint or like materials in the practice of the Sandjet process. Steel shot is found highly desirable for many furnace tube decoking operations, achieving effective decoking by impact with the coke formation, while the non-abrasive character of the shot precludes erosion to the degree encountered with the use of flint.

As indicated above, it has been found, however, that certain difficult-to-remove deposits are not removed to the extent normally desired by the Sandjet process using steel shot as the cleaning agent. Moreover, such deposits have likewise been found resistant to removal by the Sandjet process even when angular, abrasive flint is employed as the cleaning agent. It would be expected that the cleaning agents used in the practice of the invention, i.e. particles of a regular, non-random configuration, with less than spherical symmetry, would behave in a manner intermediate that found to occur when flint on the one hand, and steel shot on the other, are employed in the Sandjet process. That is, the particles used in the invention would reasonably be expected to cause less erosion than flint, but more than non-angular, non-abrasive steel shot particles. Similarly, the particles used in the invention would reasonably be expected to achieve a cleaning effectiveness as good or better than steel shot, but less than can be achieved with the angular, abrasive flint or like materials. Surprisingly and unexpectedly, the practice of the Sandjet process in accordance with the invention as herein disclosed and claimed has been found to achieve a superior cleaning action to that of either steel shot or flint and to result in a highly advantageous balance of desired cleaning action and undesired erosion of the interior surfaces of the conduit being cleaned. The invention is of particular advantage in the cleaning of conduits containing difficult-to-remove deposits for which neither of the extremes of cleaning agents heretofore employed, i.e. neither flint nor steel shot, nor a combination thereof are satisfactory in commercial practice.

The unexpected improvement in Sandjet process performance in the treatment of difficult-to-remove deposits, accomplished by means of the invention hereof, is believed to result from the aerodynamic orientation of the particles in the propelling gas stream. Steel shot is propelled through a conduit to be cleaned in a manner such that the individual shot particles tend to impact with the interior surface of the conduit, and the deposit thereon, with the glancing-blow type impact at a relatively shallow longitudinal impact angle. Similarly, flint, grit or similar irregular, abrasive particles are propelled through the conduit in a manner again resulting in a relatively shallow longitudinal impact angle. The configuration of such irregular, angular particles is such that the effective cutting angle of the angular edges of the particles with respect to the interior surface of the conduit is likewise normally shallow. The aerodynamic orientation of both steel shot and flint, grit and like materials, in the propelling gas stream appears to result not only in such shallow angles of impact with the surfaces to be cleaned, but in a limited number of impacts of the cleaning particles with the surface to be cleaned. These factors are believed to be major contributing factors in the less than satisfactory results obtained when the Sandjet process has been applied to certain high heat duty furnace decoking applications. It will be appreciated, on the other hand, that the number of impacts of the cleaning particles with the bend portions of a furnace tube, and the angles of impact of the cleaning particles with said bends tend to be significantly greater than the number of impacts and the impact angles occurring in the straight sections of the furnace tube. As a result, the bend sections of furnace tubes having even the difficult-to-remove deposits referred to herein are found to be very thoroughly decoked, while the straight sections, or portions thereof, are less than satisfactorily cleaned. It is such very effective impact action at the bends, even when non-abrasive steel shot is employed, that creates the potential for minimal erosion of welded bends referred to above. The subject invention, however, surprisingly enables more impacts of the cleaning particles with the interior surfaces of furnace tubes or other conduits to be cleaned, together with sharper angles of impact of the particles with said surfaces, so as to enhance the cleaning action of the Sandjet process, and also surprisingly enables embodiments to be employed to minimize erosion of bends or to otherwise achieve an advantageous balance of desired cleaning action and undesired erosion suitable to the requirements of a given cleaning application.

The cleaning agents used in the practice of the invention, as noted above, are particles having a regular, non-random configuration and having less than spherical symmetry. It will be appreciated that flint, grit, sand and the like have, by contrast, an irregular, random configuration. Such particles do not assume the aerodynamic orientation of the particles employed in the invention when used in the practice of the Sandjet process. Steel shot, on the other hand, possesses a regular, non-random configuration, but its spherical symmetry causes it to behave in the manner indicated above in a propelling gas stream, leading to the limited number of impacts and the shallow angle of impact with the furnace tube or other conduit interior surface and the deposit thereon. With cleaning particles that are both of a regular, non-random configuration, like steel shot, but which possess less than spherical symmetry, as does the irregular, random flint or grit particles, the cleaning results and the cleaning-erosion balance, are surprisingly and unexpectedly enhanced.

It will be understood that, as used herein, the term "spherical symmetry" is used to denote symmetry with respect to the three principal orthogonal axes of the cleaning agents. Due to the combination of less than spherical symmetry and a regular, non random configuration, the particles used in the practice of the invention are caused to behave in the propelling gas stream differently from steel shot or from flint, leading to the greater number of impacts of such particles with the surfaces to be cleaned and to sharper angles of impacts therewith than occurs with steel shot, flint or like materials. A wide variety of particle configurations falling within the criteria set forth above and in the claims can be used in the practice of the invention. Thus, the particles conveniently comprise cylindrical configurations in which the diameter is greater than the length of the particles, as with discs, slugs, washers and the like, or in which the diameter is less than the length thereof, as with cut wire particles. Other particle shapes include solid or annular geometries, such as square, rectangular, hexagonal, triangular, elliptical and similar shapes, conveniently cut from bar stock or otherwise prepared, and which would tend to behave in a manner similar to cut wire, slugs, washers or the like and can likewise be employed in the practice of the invention with or without annular openings extending therethrough. Those skilled in the art will appreciate that various other particle shapes can also be employed in the practice of the invention. For example, a boomerang shape, i.e. a regular, non-random configuration having no axis of symmetry, can be employed for the cleaning particles of the invention.

Those skilled in the art will appreciate that the various cleaning particle configurations will not all behave in the same manner in the propelling gas stream passed through the conduit to be cleaned. It is this difference in aerodynamic orientation and behavior of the various cleaning particles, in fact, that provides a useful flexibility to the process of the invention in responding to the particular requirements of any given Sandjet process application. Thus, cylindrical configurations in which the diameter is greater than the length of the particles provide a highly effective cleaning action coupled with minimized undesired erosion effects. Such particles, e.g. discs, slugs and the like with or without annular openings therethrough, provide for effective cleaning with an increased number of impacts with the surface being cleaned and sharper or increased longitudinal angles of impact, so as to be able to effectively remove deposits that cannot be satisfactorily removed by steel shot or by flint. Such particles, conveniently in the form of washers of all types, e.g. lock washers, are particularly beneficial for use in the Sandjet process as applied to conduits having straight wall sections and bends, or equivalent helical tube configurations, e.g. to furnace tubes to be decoked. The relatively large number of impacts with the surface being cleaned and the relatively sharp angles of impact resulting from the aerodynamic orientation of such particles results in effective cleaning action. Significantly, said orientation of the particles in the propelling gas stream results in a tumbling action upon impact of the particles with the surface being cleaned. It has been found, however, that erosion of the bends is minimized. The embodiments of the invention in which the diameter, or equivalent, are greater than the length of the particles, as with said washers, are particularly beneficial in the removing of difficult-to-remove deposits in furnace tube, heat exchanger or other applications in which appreciable abrasion or erosion of the bends cannot be tolerated, or must in any event be minimized. Such particles can be employed in a form such that the opposite ends thereof are rounded, with the cleaning action being principally accomplished by impact, or said opposite ends may initially have sharp edges for cleaning by abrasive action. In either event, the tumbling action of the particles is believed to contribute to the combination of effective cleaning and minimized erosion effects. It has been found that washers or other such particle configurations can be used to successfully decoke furnace tubes having coke deposits that cannot be successfully removed either by steel shot or by flint.

Cylindrical configurations in which the diameter is less than the length of the cleaning particles, e.g. cut wire, likewise provides a highly desirable and effective cleaning action based on the particular aerodynamic orientation and behavior of such particles in the propelling gas stream. Contrary to the shallow angle of impact of steel shot with the straight wall sections of a furnace tube or other conduit, cut wire or similar particles are found to have an increased number of impacts with said straight wall sections, at relatively sharp longitudinal angles of impact, such as to enhance the cleaning action of the particles with respect to said straight wall sections to be cleaned. As with washers or other shapes discussed above, the cut wire or other particles having a diameter or equivalent that is less than the length thereof can be initially employed with sharp edges at the periphery of the opposite ends thereof, for primarily abrasive-type cleaning, or can have rounded opposite ends for impact-type cleaning. Whereas, the aerodynamic action of washers enables undesired erosion of return bends to be minimized, cut wire and like particles are found to be capable of producing greater erosion than abrasive flint particles. Correspondingly, particles such as cut wire are surprisingly and unexpectedly found capable of highly effective cleaning action, beyond the capabilities of flint or steel shot, and extending to difficult-to-remove deposits including even some such deposits resistant to the effective action of washers and the like. It will be appreciated, therefore, that cleaning particles such as washers can be used to decoke some types of coke not previously removed successfully, while minimizing erosion of bends, whereas cleaning particles such as cut wire can be used for even more effective cleaning, including the removal of the most difficult types of coke, where plugged headers are employed instead of welded bends, or the system being cleaned can otherwise tolerate the level of erosion that accompanies the ability of cut wire and the like to remove deposits that are resistant to removal in other embodiments of the Sandjet process.

It will be appreciated that flint is desirable for use in certain Sandjet process applications because of the desirable or acceptable cleaning/erosion ratio achieved thereby. Shot is likewise desirable, as in various furnace tube decoking applications, because of a favorable cleaning/erosion ratio although, in terms of cleaning effectiveness alone, flint might be more desirable. In the practice of the invention using washers or the like, a significantly more favorable cleaning/erosion ratio pertains. That is, washers are able to remove more difficult-to-remove deposits that can be removed by flint, or by steel shot, while minimizing erosion of bends. Cut wire, and the like, may have a cleaning/erosion ratio similar to that of flint, but at a higher level of cleaning effectiveness and associated erosion effects. This results in an advantageous balance of desired cleaning action and undesired erosion action or effect, in those applications in which the erosion resulting from the highly effective cleaning action can be tolerated. In such applications, the cleaning action of cut wire and the like is superior not only to shot, but surprisingly to flint. Each type of cleaning agent as herein disclosed and claimed in particular embodiments of the Sandjet process has applications where they enhance and extend the capability of the in-situ Sandjet process.

The cleaning agents used in the practice of the invention can be made of any suitable material, impact resistant or not, such that they are capable of removing deposit from the surface being cleaned, either by impact or by abrasion. Cleaning agents, such as washers, cut wire, slugs and the like may conveniently be made from spring steel wire, stainless steel, carbon steel, alumina or silicon-type ceramic materials, metal oxides, diamonds or the like. It will be appreciated that the hardness of the cleaning agents employed can be varied depending upon the hardness of the deposit to be removed, and the degree to which that type of deposit appears resistant to removal upon Sandjet process cleaning, the nature of the surface to be cleaned, the design of the furnace or other unit being cleaned, i.e. the presence of welded bends, the operating conditions that can be employed in carrying out the Sandjet process, and the like. Steel particles are desirably employed in typical Sandjet process applications. While the hardness of the cleaning agents can vary depending upon the overall conditions pertaining to a given application, the agents will generally have a hardness, measured on a Rockwell C hardness scale, of from about 20 to about 65, preferably from about 30 to about 55. It will be appreciated, however, that the use of cleaning agents having other degrees of hardness, as measured on the indicated scale or some other conventional hardness scale, can be used in the practice of the invention.

Those skilled in the art will also appreciate that, while the cleaning agents herein disclosed and claimed for use in the Sandjet process provide surprising and unexpected results as is manifested most readily by their ability to successfully remove difficult-to-remove deposits not so removed by steel shot or flint, the highly effective cleaning action of such agents is applicable to the removal of less difficult-to-remove deposits as well. The greater number of impacts, and the sharper angles of impact, resulting from the aerodynamic orientation of the particles in the propelling gas stream render the invention unexpectedly superior in cleaning effectiveness, and/or in the balance of cleaning and erosion, as applied for furnace tube decoking in general and for other applications of the Sandjet process. Thus, the invention may be used to advantage not only in furnace tube decoking applications, but for pipeline cleaning, heat exchanger descaling and cleaning and other suitable applications of the in-situ Sandjet process for the cleaning of conduits. Nevertheless, it will be understood that, for purposes of convenience and economy, flint and steel shot may continue to be used advantageously for the applications in which they are now employed, with the invention being of particular advantage in the treatment of difficult-to-remove deposits not susceptible to in-situ cleaning by use of the heretofore conventional cleaning agents.

As disclosed above, washers and particles similarly having a diameter or equivalent measurement, greater than their length exhibit unexpectedly superior cleaning action as compared with flint or steel shot. Cut wire or similar particles having a greater length than diameter also exhibit such unexpectedly superior cleaning action. The high heat duty and/or thermally abused furnace applications presently found to have the most difficult-to-remove coke deposits tend to be thermal cracking units. Vacuum and atmospheric crude heaters are also found to produce tough, difficult-to-remove deposits for which the conventional use of steel shot in the Sandjet process is not entirely satisfactory for many commercial furnace requirements. Cut wire, washers and the like can advantageously be employed in such cases so that the highly desirable advantages of the Sandjet process can be extended to such furnaces.

In applying the invention to the Sandjet process cleaning of furnace tubes, heat exchanger tubes, pipelines or other conduits, the particles of cleaning agents chosen will, in addition to the desired geometry and hardness for a given deposit and underlying substrate, will have any desirable or necessary size up to that at which the longest dimension would approximate the diameter of the straight section of the conduit in a manner causing a blockage of the conduit. The operating conditions for the practice of the invention will generally be as disclosed in the Nunciato et al. patent, U.S. Pat. No. 4,297,147, referred to above. Thus, the cleaning particles will be entrained in the propelling gas stream that is passed through the furnace tubes or other conduits to be cleaned at a gas flow velocity corresponding to an outlet gas velocity of from about 5,000 feet per minute up to the sonic velocity of the propelling gas. The gas is typically nitrogen, with the sonic velocity being about 69,000 feet per minute. It will be understood that other propelling gases can be employed so long as they are compatible with the conditions pertaining to the conduit being cleaned. Air is sometimes employed as the propelling gas, the sonic velocity of air being about 68,000 feet per minute. Those skilled in the art will appreciate that the sonic velocity is the speed of sound in any particular propellant gas employed, and is the maximum velocity at which the gas can be passed through a pipeline. In practical commercial applications, the outlet gas velocity from the conduit being cleaned is from about 7,000 to about 40,000 feet per minute, with desirable results being frequently obtained by convenient operations at a gas velocity of between 14,000 and about 20,000 feet per minute. The cleaning particles entrained in the gas stream are generally furnished at a particle concentration of from about 0.1 to about 10.0, preferably from about 0.1 to 1.0, pounds of cleaning particles per pound of propellant gas. As in the Sandjet process as heretofore practiced, the flow of propelling gas is continued without the entrainment of particles therein, at intervals during the overall cleaning operation, so as to remove loose debris from the conduit. After such intervals, except at the end of the cleaning operation, the flow of propelling gas is continued with the cleaning agents entrained therein. The flow of the said particle-entrained gas stream to the conduit being cleaned is maintained for a time sufficient to effect cleaning of the conduit. It is common practice, based on experience, to maintain the flow of the gas stream until the quantity of particles in a supply pot is exhausted, after which loose debris is removed while the supply pot is refilled.

In an illustrative comparative example demonstrating the superior and unexpected results obtainable in the practice of the invention, various cleaning agents are employed in the practice of the Sandjet process for the decoking of difficult-to-remove coke from the interior surfaces of vacuum flashing tubes. Each type of particle is passed through the tubes in a propelling nitrogen stream at an outlet gas velocity of about 20,000 feet per minute. The particle concentration in each case is about 1.0 pounds of particles per pound of propellant gas. Cut wire having an 1/D ratio of 5/1 and washers, as well as steel shot particles, are made of carbon steel having a Rockwell C hardness of about 50–55. The furnace tubes comprise straight sections and welded bends, said tubes being 2–4" in diameter, with the cleaning particles each having a long dimension in the range of about ¼–½". Erosion, particularly at the bends, is found to be, in mils per 100 pounds of particles, to be minimal for steel shot, more than an order of magnitude greater for flint, intermediate steel shot and flint for washers, and, surprisingly, very much more than flint for cut wire. In terms of cleaning capability, neither the steel shot nor the flint is able to satisfactorily remove the coke from the straight sections of the tubes, although decoking is achieved in the bend sections thereof. Significantly, both washers and particularly the cut wire particles are able to remove the coke successfully from the straight sections as well as from the bend portions of the furnace tubes. Where the decoking is satisfactorily achieved by means of washers, slugs or similar materials, and where the minimizing of erosion is necessary or desirable, cleaning agents such as washers will generally be preferred as achieving the desired cleaning action while minimizing erosion. In other applications wherein the coke or other deposit is more resistant to removal so that such washers may encounter difficulty in achieving the degreee of cleaning desired, cut wire may be employed, particularly where a highly effective and relatively rapid cleaning action is needed, and the associated erosion of the bends can be tolerated. It should be noted that, while steel shot caused nearly no appreciable erosion in the illustrative example, it was ineffective for the cleaning of the coke encountered in that application. Even upon using flint in the same application, predictably resulting in significant erosion of the bends, the difficult-to-remove coke was not removed from the straight sections of the tubes. On the basis of such results, the ability of the washers to remove the coke successfully, while minimizing erosion, and the exceptional cleaning ability of the cut wire with respect to such difficult-to-remove deposits would not reasonably have been expected.

Those skilled in the art will appreciate that various changes and modifications can be made in the details of the process described herein without departing from the scope of the invention as hereinafter set forth in the appended claims. For example, the conduits to be cleaned may comprise any such conduits adapted for the transport and/or the processing of fluids, solids or mixtures thereof. As indicated above, such conduits may comprise pipelines, heat exchanger tubes, fired heater tubes used in hydrocarbon or chemical processing or any other such conduits for which the Sandjet process may be found convenient to achieve in-situ cleaning thereof. The size of the cleaning agents may be any suitable size such that the particles can be passed through the conduit to be cleaned by the propelling gas stream, typically at particle concentration within the ranges indicated above. Cut wire may be used with any convenient length to diameter, i.e. 1/D, ratio, with such wire commonly being available at an 1/D ratio on the order of from 2/1 to 10/1, typically about 3/1 to about about 5/1. It will be appreciated that 1/D ratios on either side of one will result in particles having the aerodynamic orientation and behavior as described above with respect to either washers, i.e. with an 1/D of less than one, or of cut wire, whereas at an 1/D of about 1, the aerodynamic orientation and behavior will tend to be intermediate those referred to with respect to said washers or cut wire. It is also within the scope of the invention to employ cleaning agents such as washers, cut with gear-like projections or other such edges to enhance the cleaning action of the particles.

As with the established Sandjet process for decoking applications as taught in said U.S. Pat. No. 4,297,147, the process of the invention can be carried out, in fired heater tubes or other conduits, at temperatures generally between ambient temperature and the process operating temperature at which said heater tubes or conduits are normally employed. While the unexpected and highly significant improvement in conduit cleaning performance obtained by the invention relates principally to the geometry of the cleaning particles employed, it will be understood that the performance obtained in any given application will depend on a number of factors pertaining to that application. Thus, the particle density, the gas flow velocity, the time of cleaning, the furnace or conduit design, the nature of the coke or other deposit, and the hardness of the cleaning particles employed are all pertinent to the practice of the invention and to the cleaning results obtainable thereby. The hardness of the cleaning particles can vary significantly within the indicated limits, with certain cleaning agents being found to be too soft for the particular deposit to be removed. As particles of increased hardness are employed, however, the particles will be more abrasive so that a trade-off of hardness and abrasiveness will be involved in practical applications of the invention. It is also within the scope of the invention to carry out the cleaning process using more than one type of cleaning agent as herein described, at the same time or in sequence, or to employ such particles likewise in combination with the steel shot, flint or like materials heretofore employed in the Sandjet process.

The invention provides a highly desirable flexibility to the Sandjet process and advantageously extends its scope of application, particularly in the removal of difficult-to-remove deposits. As the appreciable benefits to the use of the Sandjet process for the cleaning of conduits becomes increasingly known in the art, the benefits of the enhanced and extended capability afforded by the invention becomes increasingly desired and significant in the art. The invention represents, therefore, a major advance in the Sandjet process presently being employed in highly desirable commercial applications.

We claim:

1. An improved process for descaling and cleaning, in-situ, the interior surfaces of heat exchanger tubes having straight wall sections and a bend, or equivalent helical tube configurations, comprising:

(a) introducing cleaning particles having cylindrical configurations in which the diameter is greater than the length of said particles, or equivalent particle shapes, entrained in a propelling gas stream into said heat exchanger tubes to be descaled and cleaned at a gas flow rate corresponding to an outlet gas velocity of from about 5,000 feet per minute up to the sonic velocity of the propelling gas, said particles being of a regular, non-random configuration and having less than spherical symmetry, the cleaning particles impacting the bend and the straight sections at relatively sharp angles of impact for effective cleaning action, said particles assuming an aerodynamic orientation in the gas stream such as to result in a tumbling action upon impact with said bend and straight wall sections that minimizes abrasion of such bends; and (b) maintaining the flow of said particle-entrained gas stream to the heat exchanger tubes for a time sufficient to effect cleaning in said tubes, whereby the impacts of the cleaning particles with the interior surfaces of the heat exchanger tubes to be descaled and cleaned, and the angle of impact of said particles with said interior surfaces, are such, due to said aerodynamic orientation of the particles in said gas stream, as to maximize desired descaling and cleaning action while minimizing undesired abrasive action so as to enhance the overall heat exchanger tube descaling and cleaning operation.

2. The process of claim 1 and including continuing the flow of the propelling gas to the tubes without said particles therein, at intervals during the overall cleaning operation, so as to remove loose debris from the tubes, and thereafter repeating steps (a) and (b) to further clean the interior walls of said tubes.

3. The process of claim 1 in which said cleaning particles as initially employed have sharp edges at the periphery of the opposite ends thereof.

4. The process of claim 1 in which the opposite ends of the cleaning particles are rounded.

5. The process of claim 1 in which said cylindrical cleaning particles have annular openings extending therethrough.

6. The process of claim 1 in which the outlet gas velocity is from about 7,000 to about 40,000 feet per minute.

7. The process of claim 1 in which the concentration of particles introduced into the tubes is from about 0.1 to about 10 pounds of particles per pound of propelling gas.

8. The process of claim 1 in which the cleaning particles comprise washers.

9. The process of claim 1 in which said cleaning particles have a square configuration.

10. The process of claim 1 in which said particles have a rectangular configuration.

11. The process of claim 1 in which said particles have a triangular configuration.

12. The process of claim 1 in which said particles have a hexagonal configuration.

13. The process of claim 1 in which said particles have a elliptical configuration.

14. The process of claim 1 in which said particles have the configurafion of a boomerang.

15. An improved process for decoking and cleaning, in-situ, the interior surfaces of fired heater tubes used in hydrocarbon or chemical processing, said tubes having straight wall sections and bends, or equivalent helical tube configurations, comprising:

(a) introducing cleaning particles having cylindrical configurations in which the diameter is greater than the length of said particles, or equivalent particle shapes, entrained in a propelling gas stream into said fired heater tubes to be decoked and cleaned at a gas flow rate corresponding to an outlet gas velocity of from about 5,000 feet per minute up to the sonic velocity of the propelling gas, said particles being of a regular, non-random configuration and having less than spherical symmetry, the cleaning particles impacting the bends and the straight wall sections at relatively sharp angles of impact for effective cleaning action, said particles assuming an aerodynamic orientation in the gas stream such as to result in a tumbling action upon impact with said bends and straight wall sections that minimizes abrasion of said bends; and (b) maintaining the flow of said particle-entrained gas stream to said fired heater tubes for a time sufficient to effect decoking and cleaning in said tubes, whereby the impacts of the cleaning particles with the interior surfaces of the fired heater tubes to be decoked and cleaned, and the angle of impact of said particles with said interior surfaces, are such, due to said aerodynamic orientation of the particles in the gas stream, as to maximize the desired decoking and cleaning action while minimizing undesired abrasive action so as to enhance the overall fired heater tube decoking and cleaning operation.

16. An improved process for decoking and cleaning, in-situ, the interior surfaces of fired heater tubes used in hydrocarbon or chemical processing, said tubes having straight wall sections and bends, or equivalent helical tube configurations, comprising:

(a) introducing cleaning particles having cylindrical configurations in which the diameter is less than the length thereof, or equivalent particle shapes, entrained in a propelling gas stream into said fired heater tubes to be decoked and cleaned at a gas flow rate corresponding to an outlet gas velocity of from about 5,000 feet per minute up to the sonic velocity of the propelling gas, said particles being of a regular, non-random configuration and having less than spherical symmetry, the cleaning particles impacting the bends and the straight sections at relatively sharp angles of impact for effective cleaning action, said particles assuming an aerodynamic orientation in the gas stream such as to result in a tumbling action upon impact with said bends and straight wall sections that enhances the cleaning action of the particles with respect to said straight sections to be decoked and cleaned; and (b) maintaining the flow of said particle-entrained gas stream to the fired heater tubes for a time sufficient to effect decoking and cleaning in said tubes, whereby the impacts of the cleaning particles with the interior surfaces of the fired heater tubes to be decoked and cleaned, and the angle of impact of said particles with said interior surfaces, are such, due to said aerodynamic orientation of the particles in the gas stream, as to maximize desired decoking and cleaning action while minimizing undesired abrasive action so as to enhance the overall fired heater tube decoking and cleaning operation.

17. The process of claim 15 in which the outlet gas velocity is from about 7,000 to about 40,000 feet per minute.

18. The process of claim 16 in which the outlet gas velocity is from about 7,000 to about 40,000 feet per minute.

19. The process of claim 15 in which the concentration of particles introduced into the fired heater tubes is from about 0.1 to about 10 pounds of particles per pound of propelling gas.

20. The process of claim 16 in which the concentration of particles introduced into the fired heater tubes is from about 0.1 to about 10 pounds of particles per pound of propelling gas.

21. The process of claim 15 in which said cleaning particles comprise washers.

22. The process of claim 15 in which said particles have a square configuration.

23. The process of claim 15 in which said particles have a rectangular configuration.

24. The process of claim 15 in which said particles have a triangular configuration.

25. The process of claim 16 in which said particles have a square configuration.

26. The process of claim 16 in which said particles have a rectangular configuration.

27. The process of claim 16 in which said particles have a triangular configuration.

28. The process of claim 16 in which said cleaning particles comprise cut wire.

29. The process of claim 15 in which said cleaning particles as initially employed have sharp edges at the periphery of the opposite ends thereof.

30. The process of claim 15 in which the opposite ends of the cleaning particles are rounded.

31. The process of claim 16 in which said cleaning particles as initially employed have sharp edges at the periphery of the opposite ends thereof.

32. The process of claim 16 in which the opposite ends of the cleaning particles are rounded.

33. An improved process for descaling and cleaning, in situ, the interior surfaces of heat exchanger tubes having straight sections and a bend, or equivalent helical tube configurations, comprising:

(a) introducing cleaning particles having cylindrical configurations in which the diameter is less than the length of said particles, or equivalent particle shapes, entrained in a propelling gas stream into said heat exchanger tubes to be descaled and cleaned at a gas flow rate corresponding to an outlet gas velocity of from about 5,000 feet per minute up to the sonic velocity of the propelling gas, said particles being of a regular, non-random configuration and having less than spherical symmetry, the cleaning particles impacting the bend and the straight sections at relatively sharp angles of impact for effective cleaning action, said particles assuming an aerodynamic orientation in the gas stream such as to result in a tumbling action upon impact with said bend and straight wall sections that enhances the cleaning action of the particles with respect to said straight sections to be descaled and cleaned; and (b) maintaining the flow of said particle-entrained gas stream to the heat exchanger tubes for a time sufficient to effect descaling and cleaning, whereby the impacts of the cleaning particles with the interior surfaces of the heat exchanger tubes to be descaled and cleaned, and the angle of impact of said particles with said interior surfaces, are such, due to said aerodynamic orientation of the particles in the gas stream, as to maximize desired descaling and cleaning action while minimizing undesired abrasive action so as to enhance the overall heat exchanger tube descaling and cleaning operation.

34. The process of claim 33 in which said cleaning particles as initially employed have sharp edges at the periphery of the opposite ends thereof.

35. The process of claim 33 in which the opposite ends of the cleaning particles are rounded.

36. The process of claim 33 in which said cleaning particles comprise cut wire.

37. The process of claim 33 in which said cleaning particles have a square configuration.

38. The process of claim 33 in which said particles have the configuration of a boomerang.

39. The process of claim 33 in which said outlet gas velocity is from about 7,000 to about 40,000 feet per minute.

* * * * *